US007413245B2

(12) United States Patent
Johnson et al.

(10) Patent No.: US 7,413,245 B2
(45) **Date of Patent: *Aug. 19, 2008**

(54) LINKAGE MECHANISM FOR USE IN MOTION FURNITURE

(75) Inventors: Terry D. Johnson, Mantachie, MS (US); Bill D. Tacker, Smithville, MS (US)

(73) Assignee: L & P Property Management Company, South Gate, CA (US)

( * ) Notice: Subject to any disclaimer, the term of this patent is extended or adjusted under 35 U.S.C. 154(b) by 15 days.

This patent is subject to a terminal disclaimer.

(21) Appl. No.: 11/553,792

(22) Filed: Oct. 27, 2006

(65) Prior Publication Data

US 2007/0046075 A1 Mar. 1, 2007

Related U.S. Application Data

(62) Division of application No. 10/926,822, filed on Aug. 26, 2004, now Pat. No. 7,147,278.

(51) Int. Cl.
*A47C 1/02* (2006.01)

(52) U.S. Cl. ..... 297/85

(58) Field of Classification Search ..... 297/423.26, 297/85

See application file for complete search history.

(56) References Cited

U.S. PATENT DOCUMENTS 2,914,112 A * 11/1959 Stewart ..... 297/85
2,949,955 A * 8/1960 Barabas et al. ..... 297/85
3,400,975 A * 9/1968 Rogers, Jr. ..... 297/75
4,367,895 A * 1/1983 Pacitti et al. ..... 297/85
4,904,019 A * 2/1990 May ..... 297/85
5,141,284 A * 8/1992 LaPointe ..... 297/85
5,234,253 A * 8/1993 LaPointe et al. ..... 297/248
6,733,071 B2 * 5/2004 Guillot et al. ..... 297/85

* cited by examiner

*Primary Examiner*—Milton Nelson, Jr.
(74) *Attorney, Agent, or Firm*—Shook, Hardy & Bacon, LLP.

(57) ABSTRACT

This invention is related to a mechanism for use in motion furniture that reduces the complexity and links of typical linkage mechanisms. The mechanism has a base plate and a footrest mechanism. The mechanism also includes a seat support link coupled to the footrest mechanism and front and rear pivot links rotatably coupled to the seat support link and slidably and rotatably coupled to the base plate. An ottoman drive link is slidably and rotatably coupled to an intermediate portion of the front pivot link and rotatably coupled to an intermediate portion rear pivot link. A primary ottoman link couples the ottoman drive link and the footrest mechanism. The primary ottoman link is rotatably coupled to the seat support link at an intermediate portion, so that the primary ottoman link and the ottoman drive link cooperate to move footrest mechanism between a closed chair position and an open recliner position. A backrest linkage couples the seat support link to the base plate, so that the backrest linkage cooperates to move the recliner mechanism between the open recliner position and the fully-reclined position.

13 Claims, 8 Drawing Sheets

LINKAGE MECHANISM FOR USE IN MOTION FURNITURE

CROSS-REFERENCE TO RELATED APPLICATIONS

This application is a Divisional Application that claims the benefit of U.S. patent Ser. No. 10/926,822, filed Aug. 26, 2004 now U.S. Pat. No. 7,147,278.

STATEMENT REGARDING FEDERALLY SPONSORED RESEARCH OR DEVELOPMENT

Not applicable.

BACKGROUND OF THE INVENTION

This invention relates to a linkage mechanism for a chair or other type of motion furniture, and more particularly to a zero-wall recliner mechanism for a recliner chair or other type of motion furniture that may be placed within zero to five inches of a wall.

Zero-wall recliners and other types of motion furniture are generally well known in the furniture industry. While recliners or zero-wall recliners are discussed throughout this specification, the concepts and inventive subject matter extend equally across motion furniture generally, as would be understood by those of skill in the art. Generally, zero-wall motion furniture is reclining furniture that may be placed in close proximity to a wall. Specifically, zero-wall recliners are recliners that may be placed within zero to five inches of a wall, depending on the height of the back. Zero-wall recliners are equipped with extendable footrests that allow the user to recline. A number of alternative link configurations are currently used in the motion mechanism that moves the chair between the reclined position and stowed position. The link configurations used in the reclining mechanism are complex and involve numerous links and pivot points. Thus, the zero-wall reclining mechanisms currently in use involve a high number of moving parts. The high quantity of moving parts translates into high production costs, namely, high machining costs, material costs, and assembly costs. Moreover, each pivot point presents the risk of a maintenance concern, such as noise or wear.

Thus, while a great many motion mechanisms are known, there remains a need for an improved motion mechanism that achieves the desired motion with a reduced number of moving parts. Specifically, there is a need for a less complex motion mechanism with fewer links and pivot points.

BRIEF SUMMARY OF THE INVENTION

Accordingly, the present invention provides a motion mechanism for furniture with a reduced number of links and pivot points as compared with known linkages. The mechanism of the present invention is movable between a closed position, an open, intermediate position, and a fully-reclined position. In use with a zero-wall recliner, the mechanism is movable from the closed, sitting position to an intermediate, reclined position to a fully-reclined position. The motion that is achieved is similar to that of existing zero-wall recliners, but is achieved with a reduced number of mechanism links and pivot points.

In general the recliner includes a seat, side panels, a front footrest, a backrest and various recliner mechanism components. These recliner mechanism components generally include a base plate, a footrest mechanism, and a recliner mechanism. The recliner mechanism is rotatably and slidably coupled to the base plate and is rotatably coupled to the footrest mechanism. The recliner mechanism is connected to the footrest mechanism by a footrest extension linkage and a primary ottoman link.

The recliner mechanism broadly includes a seat support link, an ottoman drive link and a back linkage. The seat support link is coupled to the base plate by a pair of pivot links. The ottoman drive link is coupled on one end to the back pivot link and on the other end to the primary ottoman link. Between the two ends, the ottoman drive link is coupled to the front pivot link. This coupling is achieved with a pin and slot. In one embodiment, the slot is formed in the ottoman drive link. A pin extends from the front pivot link and is held within the slot. In another embodiment, the slot is formed in the front pivot link and the corresponding pin extends from the ottoman drive link. In either case, the slot pin coupling, along with the ottoman drive link shape, allows the recliner mechanism to achieve the desired motion with fewer links and pivot points.

The recliner mechanism also includes a back linkage that is coupled to the seat support link and serves to move the chair from the open, intermediate position to the fully-reclined position when the user provides additional rearward reclining force. The back linkage is coupled to the seat support link and includes a back bracket, a rear toggle link, and a rear bell crank. The back bracket is rotatably coupled to the seat support link at its forward end and is rotatably coupled to the rear toggle link at its aft end. Opposite its connection to the seat support link, the rear toggle link is rotatably coupled to the rear bell crank at a pivot point. The rear bell crank is rotatably coupled to the seat support link at its upper end and is rotatably coupled to a rear connector link at its lower end. The rear connector link serves to interconnect the rear bell crank to the base plate. In an alternative embodiment, the bell crank is coupled to the back bracket utilizing a pin and slot arrangement. In this embodiment, the bell crank and back bracket are shaped slightly differently from the first embodiment. The second embodiment allows even fewer links and pivot points.

Like other motion furniture, to move the recliner from the closed chair position to the open recliner position, the user rotates a release lever rearwardly. The rearward rotation of the lever serves to unlock a footrest extension linkage, thereby allowing the weight of the user to move the recliner mechanism from the closed chair position to the open recliner position. The user may then fully recline the chair by pushing back on the backrest while grasping the side panels.

As will be seen from the detailed description that follows, the mechanism of the invention provides a zero-wall recliner mechanism that utilizes fewer linkage components than any linkages in the prior art. Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
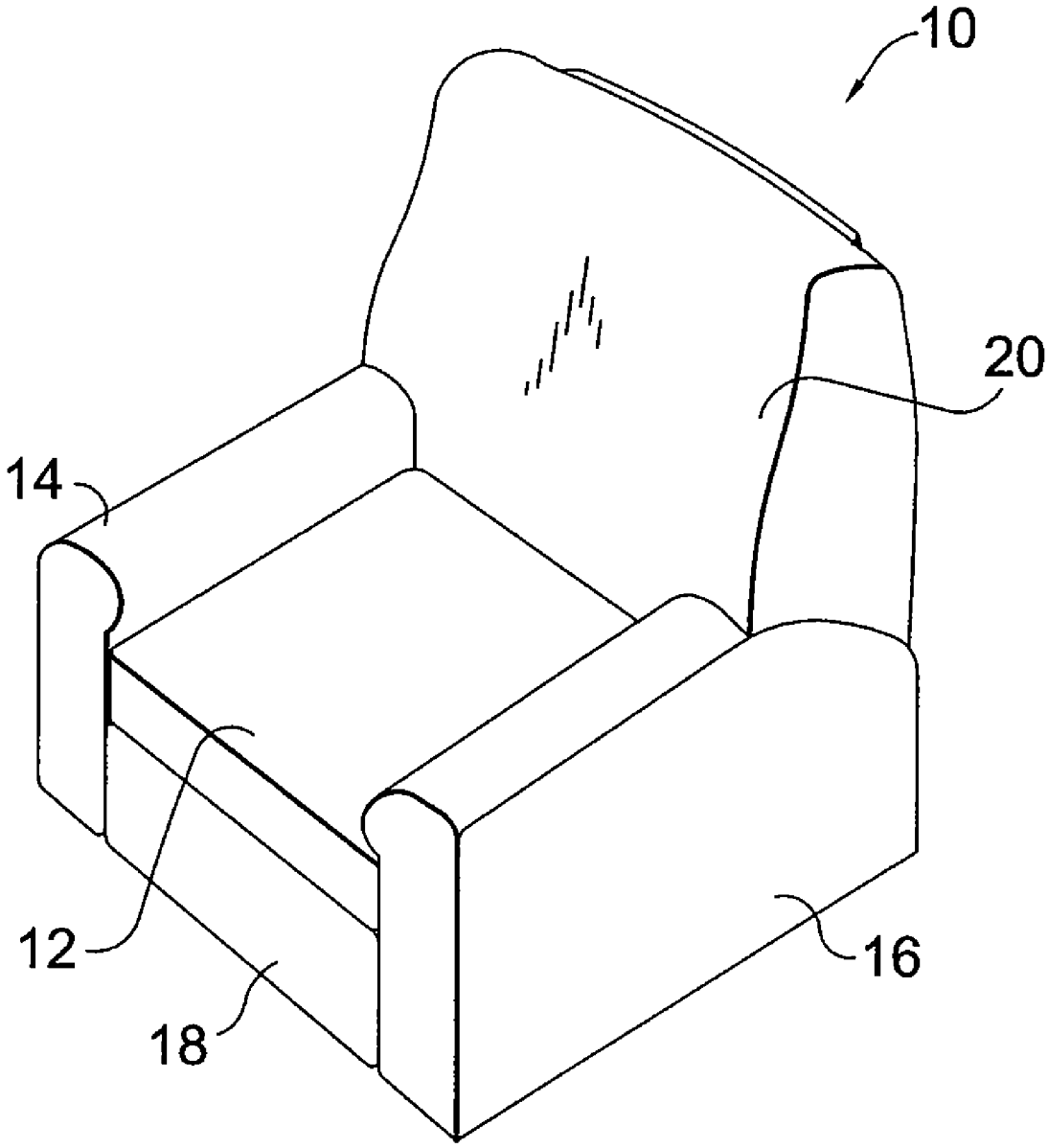
FIG. 1 is a front perspective view of a recliner chair in the closed, chair position according to the present invention.

Referring to the drawings in greater detail and initially to FIG. 1, a recliner is shown and designated generally by the numeral 10. Recliner 10 broadly includes a seat 12, a pair of side panels 14, 16, a front footrest 18, and a back 20. Again, while the invention is discussed with respect to a recliner 10, the invention is in no way limited to reclining chairs. As would be understood by those of skill in the art, the invention applies generally to reclining motion furniture.

Figure 2:
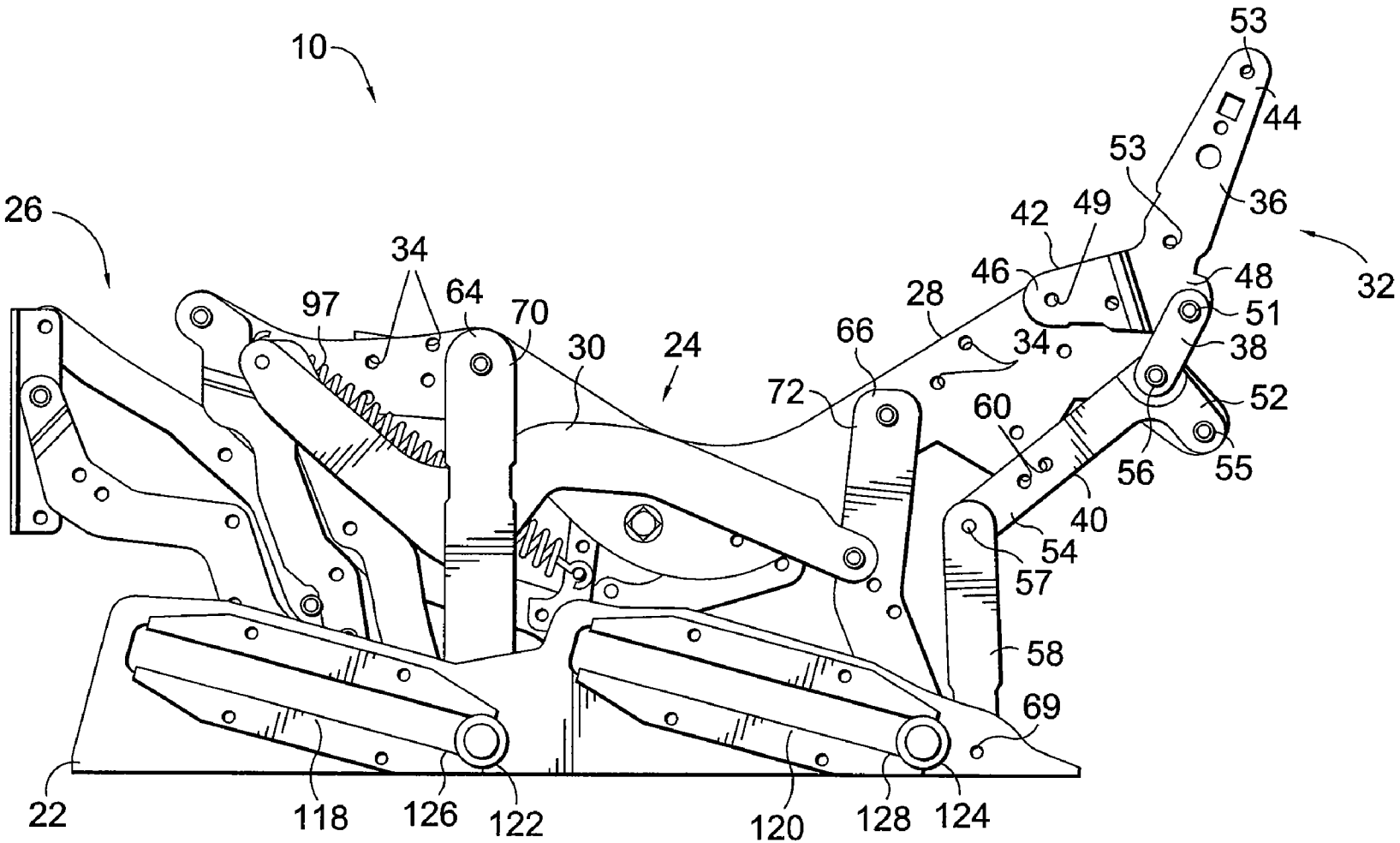
FIG. 2 is a partial cross-sectional view of a recliner showing the mechanism in the closed, chair position.
Figure 3:
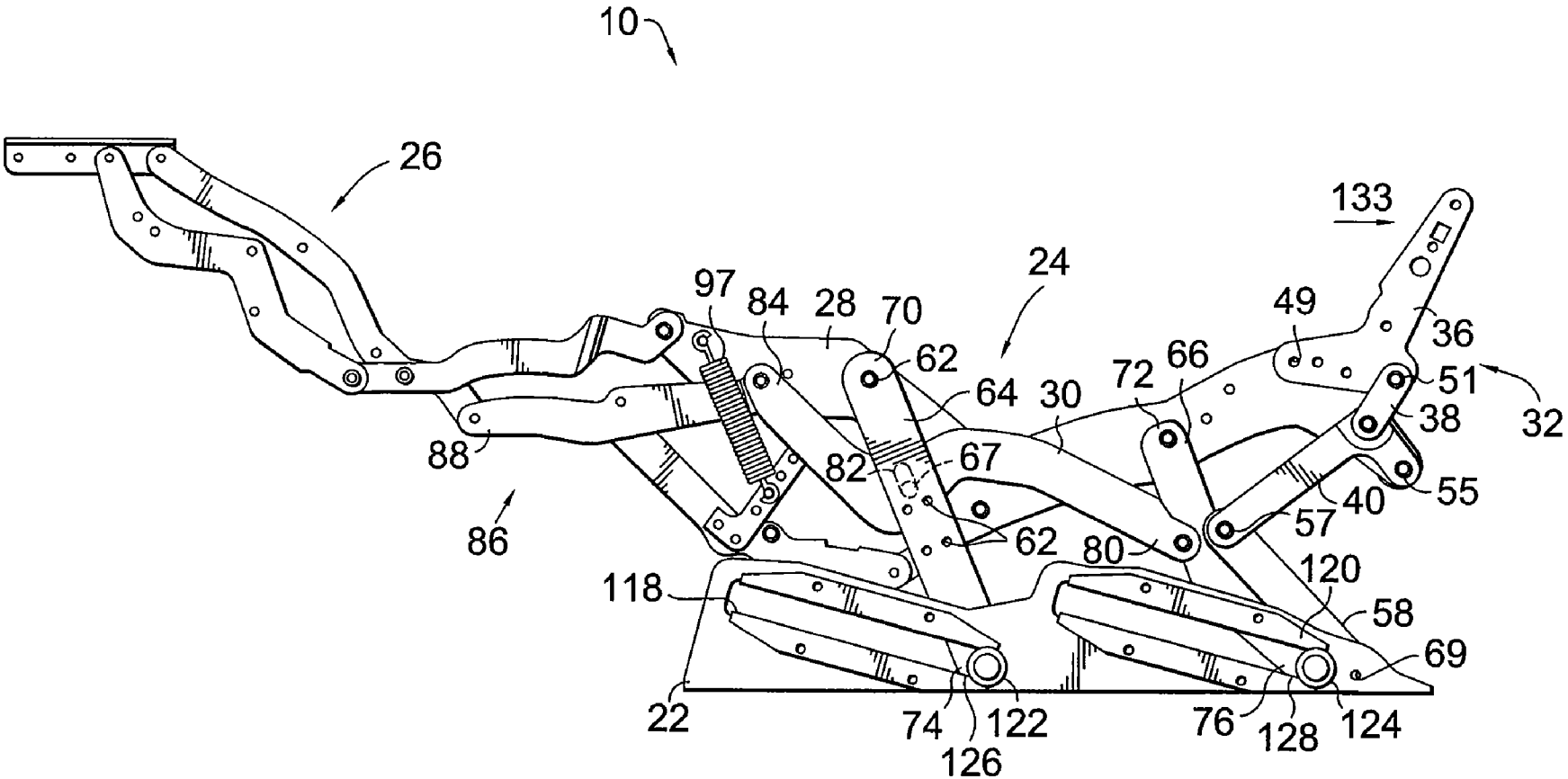
FIG. 3 is a view similar to FIG. 2, but with the recliner mechanism in the open, recliner position.
Figure 4:
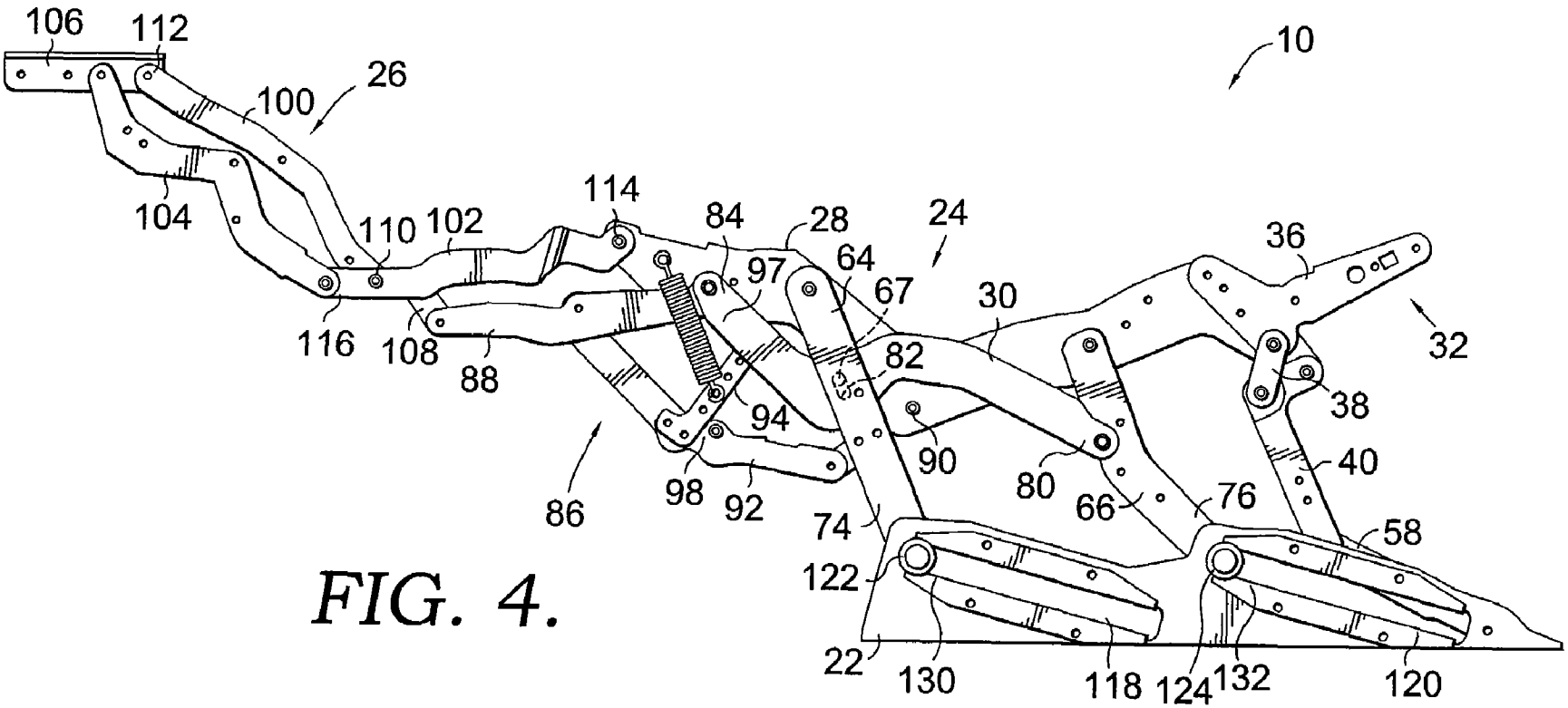
FIG. 4 is a view similar to FIG. 2, but with the recliner mechanism in the fully-reclined position.

The internal linkages of recliner 10 that operate to move the recliner 10 from the closed position of FIG. 1 to an open recliner or fully-reclined position are best seen in FIGS. 2-4. The side panels 14, 16, the front footrest 18, and the back 20 are not shown in FIGS. 2-4 for clarity. As best seen in FIGS. 2-4, the motion mechanism of the recliner 10 broadly includes a base plate 22, a recliner mechanism 24, a footrest mechanism 26, and a back linkage 32. It will be appreciated that the above referenced items contain near mirror-image replicas on each side of the recliner.

Base plate 22 is the point about which the linkages, described below, move. Recliner mechanism 24 is rotatably and slidably coupled to base plate 22, as is further described below. Additionally, recliner mechanism 24 is rotatably coupled to footrest mechanism 26. Throughout this specification, certain links are described as coupled to one another. For these couplings, any suitable attachment mechanism could be used, such as bolts, pins, rivets or the like. Thus, recliner mechanism 24 serves to interconnect footrest mechanism 26 and base plate 22. Additionally, back linkage 32 is movably coupled to recliner mechanism 24, so recliner mechanism 24 also interconnects back linkage 32 and base plate 22. Each of these components is discussed in more detail below.

FIG. 2 illustrates the recliner mechanism 24 in the closed position with the footrest mechanism 26 in the retracted position. FIG. 3 illustrates the recliner mechanism 24 in an open recliner position, with the footrest mechanism 26 in the extended position. In this position, the back 20, not shown, remains somewhat upright. FIG. 4 illustrates the recliner mechanism 24 in a fully-reclined position, with the footrest mechanism 26 in the extended position. In this position, the back 20, not shown, is in the fully-reclined position. These three positions are known for existing motion furniture. However, as will be seen and described, the present invention achieves this motion and these positions in an improved way, with fewer links and pivot points.

With further reference to FIGS. 2-4, the recliner mechanism 24 includes, among other things, a seat support link 28 and an ottoman drive link 30. The description that follows will discuss the various links and will, in general, begin with seat support link 28 and the various other links as they relate to seat support link 28. Seat support link 28 is a generally elongated piece of shaped stamped steel, as shown, with a plurality of connecting apertures 34. A number of other links and linkages are coupled to seat support link 28. As best seen in FIG. 2, back linkage 32 is coupled to the seat support link 28. The back linkage 32 generally includes a back bracket 36, a rear toggle link 38, and a rear bell crank 40. Back bracket 36 is generally L-shaped and includes a lower leg 42 and an upper leg 44. Upper leg 44 contains mounting holes 53 used to couple it to back 20 (not shown), as is well understood in the art. Lower leg 42 includes a forward portion 46 and an aft portion 48. Forward portion 46 contains an aperture 49 used to rotatably couple it to seat support link 28. Aft portion 48 also contains an aperture, not shown, that is used to couple it to a first end of rear toggle link 38 at pivot point 51. The second end of rear toggle link 38 is rotatably coupled to bell crank 40 at pivot point 56. Thus rear toggle link 38 serves to interconnect aft portion 48 of back bracket 36 to pivot point 56 on rear bell crank 40, the importance of which will be described further below. Rear bell crank 40 is generally L-shaped and includes an upper end 52, a lower end 54, and a pivot point 56. Upper end 52 is rotatably coupled to a rear portion of the seat support link 28 at pivot point 55. Lower end 54 is rotatably coupled to a rear connector link 58 at pivot point 57. The opposite end of link 58 is connected to base plate 22 at pivot point 69. Rear connector link 58 thus serves to interconnect rear bell crank 40 and base plate 22.

Figure 3A:
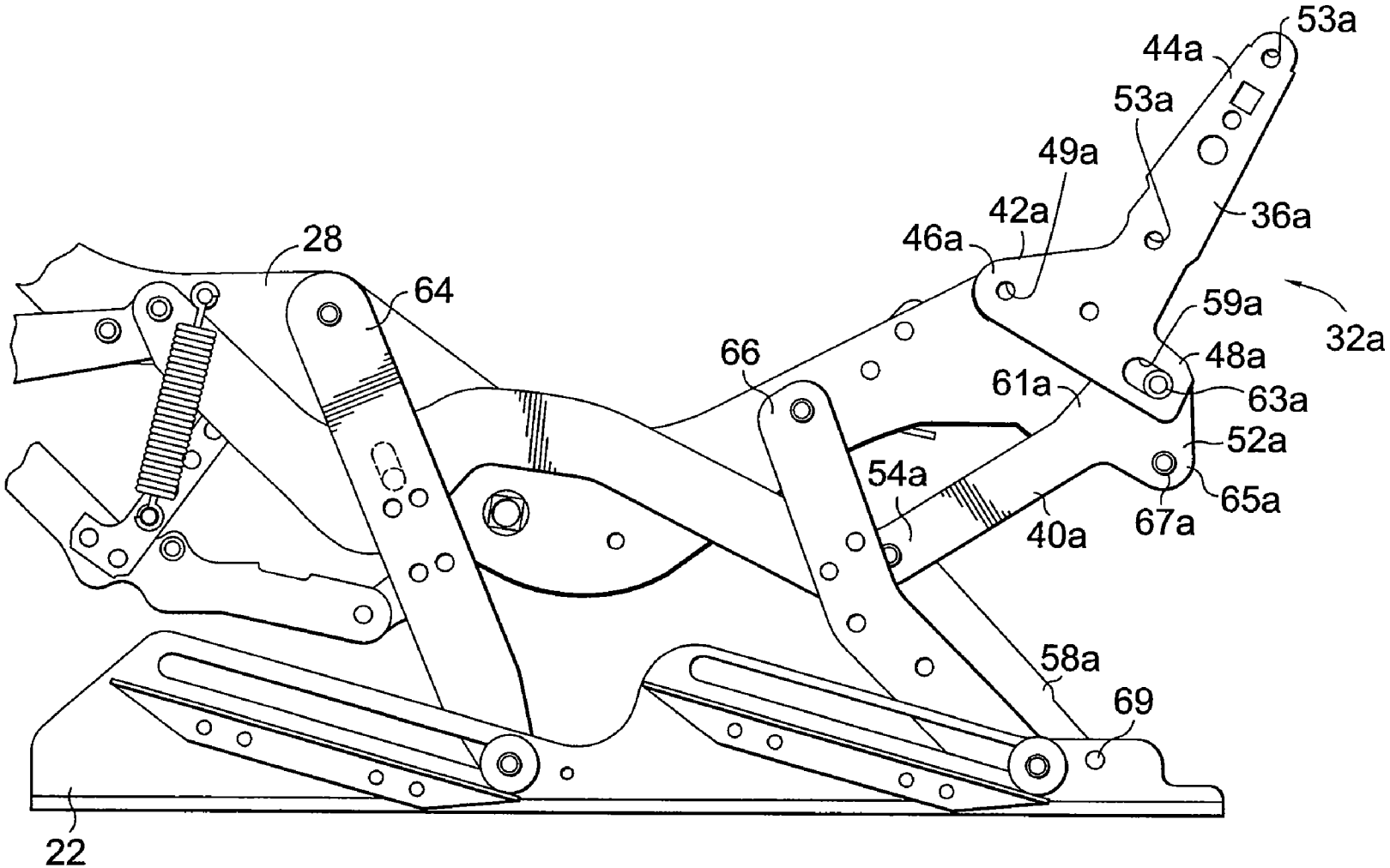
FIG. 3*a* is a partial, enlarged view similar to FIG. 3, but showing a different embodiment of the back bracket and bell crank.
Figure 6:
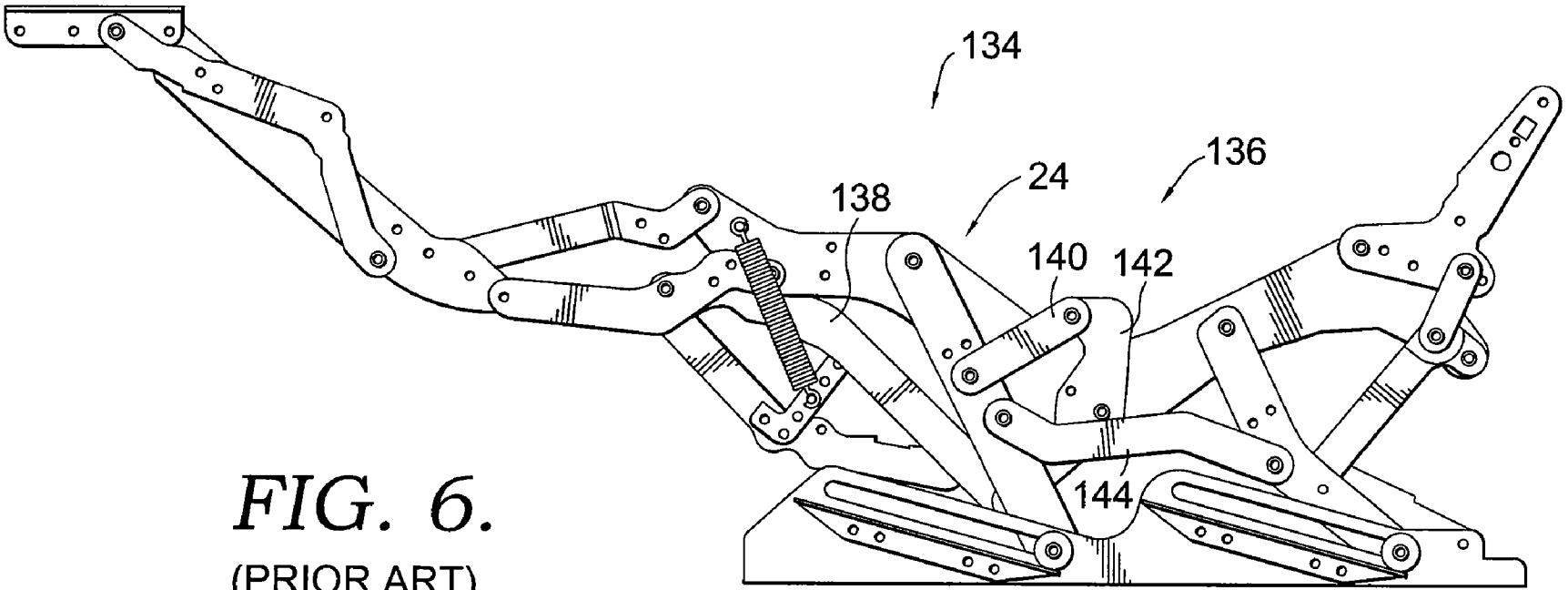
FIG. 6. (PRIOR ART)
FIG. 6 is a view of a prior art embodiment.

Referring now to FIG. 3*a*, an alternate embodiment of the back linkage 32*a* is shown. The back linkage 32*a* generally includes a back bracket 36*a* and a rear bell crank 40*a*. Rear toggle link 38, shown in FIGS. 3 and 6, is not needed in this embodiment due to the configuration and connection of bracket 36*a* and rear bell crank 40*a*. Back bracket 36*a* is generally L-shaped and includes a lower leg 42*a* and an upper leg 44*a*. Lower leg 42*a* includes a forward portion 46*a* and an aft portion 48*a*. Forward portion 46*a* contains an aperture 49*a* used to rotatably couple it to seat support link 28. Upper leg 44*a* contains mounting holes 53*a* used to couple it to back 20 (not shown), as is well understood in the art. Aft portion 48*a* contains a slot 59*a* used to slidably and rotatably couple bracket 36*a* to a first end of rear bell crank 40*a*.

Rear bell crank 40*a* is generally shaped as shown and includes an upper end 52*a* and a lower end 54*a*. Upper end 52*a* includes forward portion 61*a* with a pin 63*a* projecting therefrom and an aft portion 65*a* with an aperture 67*a*. Pin 63*a* is positioned within slot 59*a*. Thus, pin 63*a* and slot 59*a* serve to slidably and rotatably interconnect forward portion 61*a* of upper end 52*a* to aft portion 48*a* of lower leg 42*a*. Aft portion 65*a* of upper end 52*a* is rotatably coupled to the rear portion of seat support link 28 via aperture 67*a*. Lower end 54*a* is rotatably coupled to a rear connector link 58*a*. Rear connector link 58*a* serves to interconnect rear bell crank 40*a* and base plate 22 at pivot point 69. The remainder of the embodiment contained in FIG. 3*a* is the same as the embodiment disclosed in FIG. 3. It can be seen that the embodiment of FIG. 3*a* results in one less link, as link 38 is not needed. By removing link 38, one less pivot connection is needed. Thus, the embodiment of FIG. 3*a* serves to further reduce the number of links and pivot points. It will be appreciated by one with ordinary skill in the art that the slot 59*a* may also be located in rear bell crank 40*a* and the pin 63*a* may project from the back bracket 36*a*.

Figure 5:
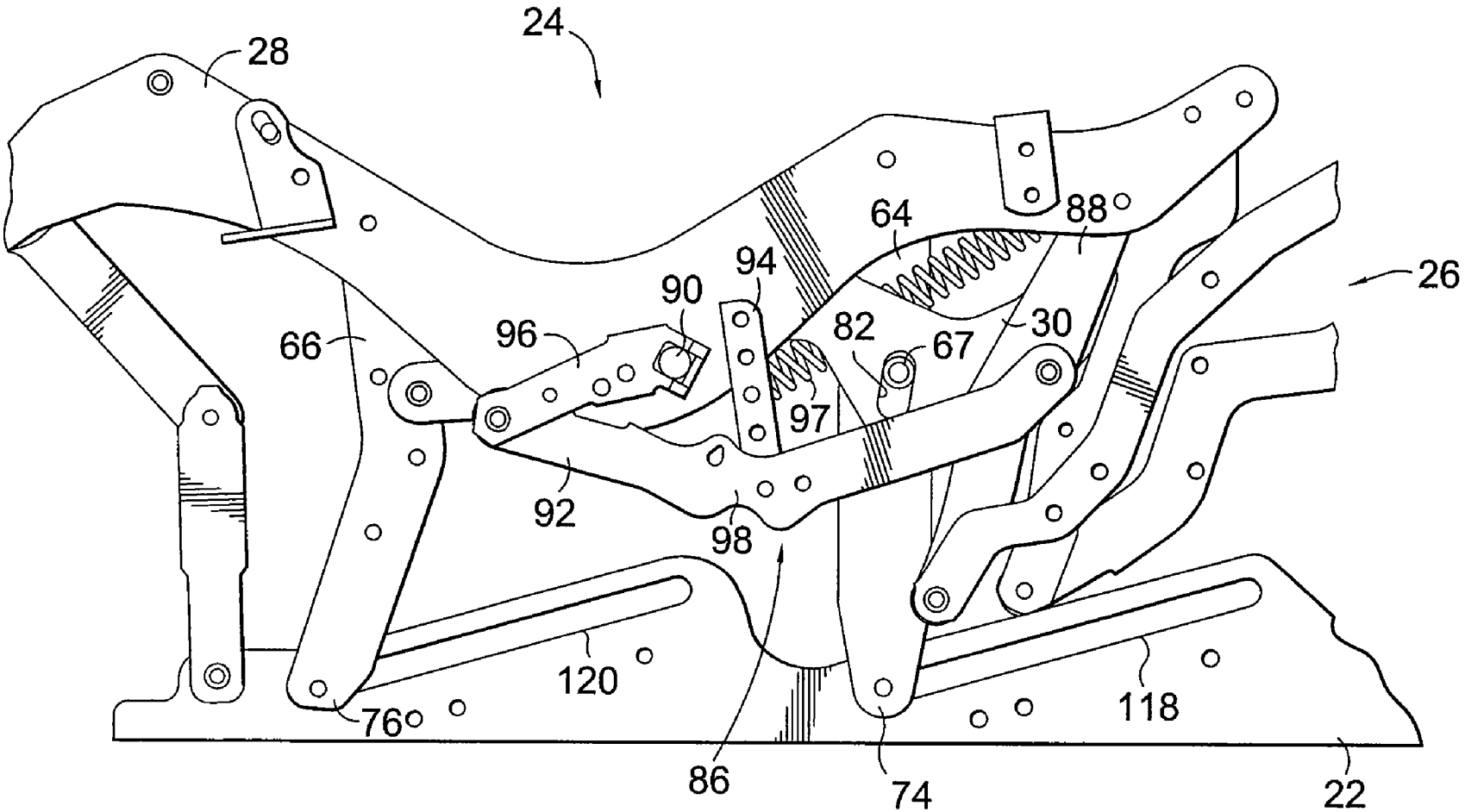
FIG. 5 is a partial, enlarged view similar to FIG. 2, but showing a view from the opposite side.

Returning to FIG. 2, and the discussion of mechanism 24, the seat support link 28 is directly coupled to base plate 22 through a front pivot link 64 and a rear pivot link 66. Thus, front pivot link 64 and rear pivot link 66 directly attach seat support link 28 to base plate 22. Front pivot link 64 and rear pivot link 66 are elongated links containing a number of connecting apertures 62, as best seen in FIG. 3. Front pivot link 64 and rear pivot link 66 are rotatably coupled to seat support link 28 at their upper ends 70, 72. As best seen in FIG. 5, front pivot link 64 and rear pivot link 66 are both rotatably and slidably coupled to base plate 22 at their lower ends 74, 76. As best seen in FIGS. 3, 4, and 5, front pivot link 64 has a pin 67 protruding from it that is located at an intermediate portion, the importance of which will be described in further detail below. Pin 67 is affixed to and projects outwardly from front pivot link 64.

The ottoman drive link 30 is coupled to, among other links, pivot links 64 and 66. The ottoman drive link 30 is best described with reference to FIGS. 3, 4 and 5. With initial reference to FIG. 3, link 30 is an S-shaped elongate link and includes an attaching end 80, a slot 82, and a drive end 84. Slot 82 is generally vertical in orientation and is located at an intermediate position of ottoman drive link 30. Ottoman drive link 30 is rotatably coupled to rear pivot link 66 at its attaching end 80. Attaching end 80 has a hole therethrough, which facilitates fastening ottoman drive link 30 to an intermediate portion of rear pivot link 66. Ottoman drive link 30 is rotatably and slidably coupled to an intermediate portion of front pivot link 64 via pin 67 and slot 82. The shape of ottoman drive link 30, along with the connection provided by slot 82 and pin 67 reduces the number of links needed, as well as the number of pivot points. As stated above, this reduction results in a cost savings, as well as in a less complex mechanism, as compared with the mechanism currently in use. It will be appreciated by one with ordinary skill in the art that the slot 82 may also be located in front pivot link 64 and the pin 67 may project from the ottoman drive link 30. Drive end 84 is rotatably coupled to a footrest mechanism 26, as described in further detail below.

Figure 4A:
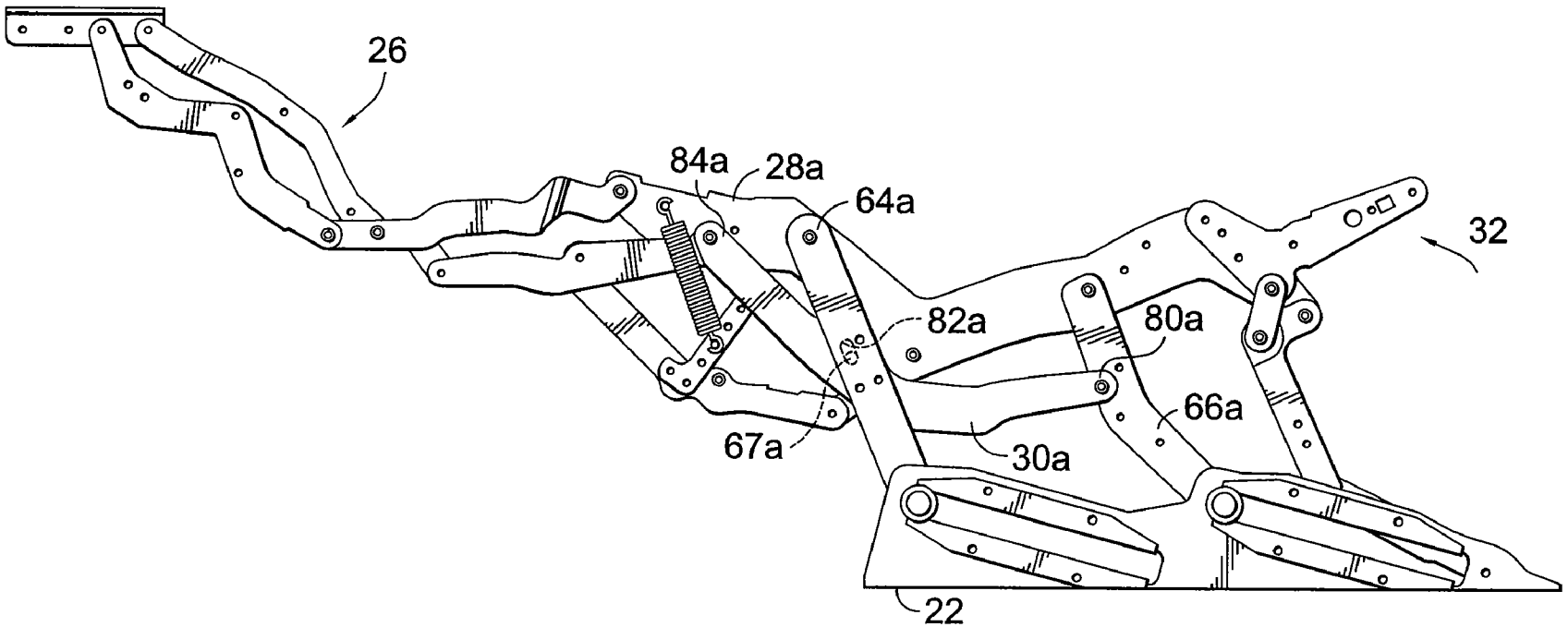
FIG. 4*a* is a view similar to FIG. 4, but showing a different embodiment of the ottoman drive link.

Referring now to FIG. 4*a*, a different embodiment of the ottoman drive link 30*a* is shown. Ottoman drive link 30*a* is a curved elongate link and includes an attaching end 80*a*, a slot 82*a*, and a drive end 84*a*. Slot 82*a*, shown by broken lines, is generally vertical in orientation and is located at an intermediate position of ottoman drive link 30*a*. Ottoman drive link 30*a* is rotatably coupled to rear pivot link 66*a* at its attaching end 80*a*. Attaching end 80*a* has a hole therethrough, which facilitates fastening ottoman drive link 30*a* to an intermediate portion of rear pivot link 66*a*. Ottoman drive link 30*a* is rotatably and slidably coupled to an intermediate portion of front pivot link 64*a* via pin 67*a* at slot 82*a*. The remainder of the embodiment contained in FIG. 4*a* is the same as the embodiment disclosed in FIG. 4. The main difference between link 30 and link 30*a* being the differences in shapes of the two lines. This embodiment, like that of FIG. 4 discussed above, results in a less complex mechanism with a reduced number of links and pivot points. While two embodiments of the ottoman drive link have been shown and described, the invention is not limited to these embodiments. As would be understood by one of skill in the art, other shapes and configurations of the ottoman drive link are possible and are within the scope of the invention.

The description will next focus on footrest mechanism 26. Footrest mechanism 26 cooperates with a footrest extension linkage 86 and a primary ottoman link 88 to extend and retract the footrest. Returning to FIG. 4, the footrest mechanism 26 is connected to the recliner mechanism 24 by footrest extension linkage 86 and primary ottoman link 88. It will be understood that the footrest extension linkage 86 operates to place the footrest mechanism 26 in a retracted position, as best seen in FIG. 2, and in an extended position, as best seen in FIG. 3. Footrest extension linkage 86 allows footrest mechanism 26 to remain in the extended position as chair 10 moves to the fully-reclined position of FIG. 4. Referring now to FIGS. 4 and 5, the footrest extension linkage 86 generally includes a handle or other activation device, not shown, a shaft 90, an ottoman lock link 92, a spring bracket 94, a release link 96, (FIG. 5), and a spring 97. As is understood, shaft 90 is mounted between seat support links 28 on each side. The handle or other activation device, not shown, is typically positioned on one side of chair 10 and is fixably mounted to shaft 90. As shown in FIG. 5, release link 96 is also fixably mounted to shaft 90 and is rotatably coupled to ottoman lock link 92. Spring bracket 94 is coupled at its lower end to an intermediate portion 98 of ottoman lock link 92. Ottoman lock link 92 is rotatably coupled to an intermediate portion of primary ottoman link 88. Thus, ottoman lock link 92 serves to interconnect release link 96 to primary ottoman link 88. As seen in FIG. 4, spring 97 is coupled to spring bracket 94 at one end and is coupled to a forward portion of the seat support link 28 at the opposite end. Primary ottoman link 88 is rotatably coupled to drive end 84 of ottoman drive link 30 and is pivotably coupled to seat support link 28.

The footrest mechanism 26 includes a drive link 100, an intermediate link 102, a footrest mounting link 104, and a bracket 106. Drive link 100 has a drive end 108, a pivot 110, and an upper end 112. Drive link 100 is rotatably coupled to primary ottoman link 88 at drive end 108 and is coupled to bracket 106 at upper end 112. Intermediate link 102 includes an upper end 114 and a lower end 116. Intermediate link 102 is rotatably coupled to seat support link 28 at upper end 114 and rotatably coupled to footrest mounting link 104 at lower end 116. Intermediate link 102 is pivotably coupled to drive link 100 at pivot 110 and, thus, forms a scissor linkage with drive link 100. Opposite the connection of footrest mounting link 104 to intermediate link 102, footrest mounting link 104 is coupled to bracket 106. Bracket 106 is generally rectangular and contains a number of apertures for fastening the footrest 18, not shown.

Referring now to FIGS. 2 and 5, base plate 22 is generally well-known in the art and includes a pair of elongate channels 118, 120. As stated above, lower ends 74, 76 of front pivot link 64 and rear pivot link 66 are slidably and rotatably coupled to elongate channels 118, 120, respectively. Attachment of front pivot link 64 and rear pivot link 66 to elongate channels 118, 120, respectively, occurs via a pair of rollers 122, 124. Referring now to FIGS. 2-3, it can be seen that rollers 122 and 124 are located at lower portions 126, 128 of elongate channels 118, 120 in the closed chair position and open recliner position. FIG. 4 shows the rollers 122 and 124 in the upper portion 130, 132 of elongate channels 118, 120 in the fully-reclined position. As can be seen, elongate channels 118, 120 serve to guide rollers 122, 124 of front pivot link 64 and rear pivot link 66 forwardly and upwardly as the recliner 10 goes from the open recliner position of FIG. 3 to the fully-reclined position of FIG. 4.

The operation of the recliner 10 is best described with reference to FIGS. 2-4. FIG. 2 represents the recliner 10 in the closed, chair position, position one. FIG. 3 represents the recliner 10 in the open, recliner position, position two. FIG. 4 represents the ottoman recliner 10 in the fully reclined position, position three. Referring now to FIG. 5, if the occupant desires to convert from position one to position two, the user rotates the handle or other activation device, rearwardly. This rearward rotation causes a downward rotation of release link 96 coupled thereto through shaft 90. The downward rotation of release link 96 unlocks the ottoman lock link 92. As best seen in FIGS. 3 and 5, once the ottoman lock link 92 is unlocked, the weight of the user causes the recliner mechanism 24 to move forward. The spring 97 serves to maintain the footrest extension linkage 86 in the locked position and, thus, the footrest mechanism 26 in the closed position, position one. The spring 97 further functions to assist opening footrest mechanism 26 from position one to position two once the footrest extension linkage has been unlocked. Still further, the spring 97 assists in holding the footrest mechanism 26 in the extended position.

As the recliner mechanism 24 moves forwardly, the seat support link 28 moves forwardly about front pivot link 64 and rear pivot link 66. As best shown with reference to FIGS. 2 and 3, front pivot link 64 and rear pivot link 66 pivot about lower portions 126, 128 of elongate channels 118, 120. Forward movement of front pivot link 64 and rear pivot link 66 translates into a clockwise (as viewed in FIGS. 2 and 3) motion of primary ottoman link 88 and extends footrest mechanism 26 to position two shown in FIG. 3. When the recliner mechanism is in the closed position of FIG. 2, the pin 67 is located at an intermediate portion of the slot 82. As the recliner mechanism 24 moves forward from the position in FIG. 2 to the position in FIG. 3, the pin 67 oscillates in the slot 82. Thus, the generally vertical orientation of the pin 67 and slot 82 allows the ottoman drive link 30 to oscillate vertically as needed to drive the footrest mechanism 26 while limiting the horizontal motion of the front pivot link 64, thereby controlling the movement of the front pivot link 64.

Referring now to FIGS. 3-4, to move from position two to position three, additional force as represented by reference numeral 133 is applied to back bracket 36 via back 20, not shown. Force 133 causes a clockwise rotation of back bracket 36 about pivot point 49. The clockwise rotation of back bracket 36 in turn causes a force to be generated through rear toggle link 38 and causes rear bell crank 40 to rotate. The force and rotation causes a downward rotation of rear connector link 58. These actions in turn cause the lower ends 74, 76 of front pivot link 64 and rear pivot link 66 to travel upwardly and forwardly within elongate channels 118, 120 and move the recliner from position two, shown in FIG. 3, to position three, shown in FIG. 4.

The above-described linkage mechanism provides a linkage for motion furniture such as a zero-wall recliner that is less complex than other prior art linkages. The mechanism utilizes fewer links, and thus less material, while achieving the same functionality. To aid in the illustration, a prior art mechanism is briefly described.

Referring now to FIG. 6, a previous embodiment of a linkage for a zero-wall recliner is shown and designated by numeral 134. With reference to FIGS. 3 and 6, the previous embodiment 134 and the recliner 10 contain similar configurations with a few important exceptions. The differences between the previous embodiment 134, shown in FIG. 6, and the recliner 10 that is described above relate to the recliner mechanism 24. As stated above, the recliner mechanism 24 contains an ottoman drive link 30. Ottoman drive link 30 of the present invention is a single elongated link that replaces several links in the previous embodiment. Referring to FIG. 6, the ottoman drive mechanism of the previous embodiment consists of a drive link 138, a toggle link 140, a bell crank 142, and a control link 144. The remainder of the linkage remains relatively the same as the present invention. As can best be seen when comparing FIGS. 6 and 4, the drive link 138, toggle link 140, bell crank 142, and control link 144 represented in FIG. 6 are replaced by the single ottoman drive link 30 as shown in FIG. 4. Link 30, acting within the mechanism, achieves the desired motion and eliminates a number of links and pivot points as compared to the previous linkage mechanisms known in the art. The slot and pin coupling between link 30 and front pivot link 64 along with the overall shape of link 30 thus provides a less complex mechanism that can achieve the desired motion. It should be understood, however, that shapes and configurations of link 30 could be used and are within the scope of the present invention. Additional link reduction is provided in the back linkage 32*a* as shown and discussed with respect to FIG. 3*a*.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A linkage mechanism for use in motion furniture, comprising:

a base plate;

a footrest linkage;

a seat support link coupled to the footrest linkage;

front and rear pivot links rotatably coupled to the seat support link and slidably and rotatably coupled to the base plate;

an ottoman drive link slidably and rotatably coupled to an intermediate portion of the front pivot link and rotatably coupled to an intermediate portion of the rear pivot link, wherein the ottoman drive link is a curved elongate link with a slot formed therein and located at an intermediate portion;

a primary ottoman link coupled between the ottoman drive link and the footrest linkage, the primary ottoman link rotatably coupled to the seat support link, wherein the primary ottoman link and the ottoman drive link cooperate to move the footrest linkage between a closed position and an open position; and a backrest linkage coupling the seat support link to the base plate.

2. The linkage mechanism of claim 1, wherein the slidable and rotatable coupling between the ottoman drive link and the front pivot link is a pin and slot coupling.

3. The linkage mechanism of claim 1, wherein the backrest linkage includes a back bracket coupled to the seat support link, a rear bell crank with an upper and lower portion, the upper portion rotatably coupled to the back bracket and rotatably coupled to the seat support link, the lower portion rotatably coupled to the base plate.

4. The linkage mechanism of claim 1, wherein the orientation of the slot within the ottoman drive link is generally vertical.

5. A recliner mechanism operable within a recliner chair having a base plate and a footrest mechanism, the recliner mechanism comprising:

a seat support link configured for coupling with the footrest mechanism of the recliner chair;

front and rear pivot links rotatably coupled to the seat support link and configured for slidable and rotatable coupling with the base plate of the recliner chair;

an ottoman drive link slidably and rotatably coupled to an intermediate portion of the front pivot link and rotatably coupled to an intermediate portion of the rear pivot link, wherein the ottoman drive link is a curved elongate link with a slot formed therein and located at an intermediate portion;

a primary ottoman link configured for coupling the ottoman drive link and the footrest mechanism of the recliner chair, the primary ottoman link rotatably coupled to the seat support link at an intermediate portion, wherein the primary ottoman link and the ottoman drive link cooperatively enable movement of the footrest mechanism of the recliner chair between a closed chair position and an open recliner position; and a backrest linkage configured for coupling the seat support link to the base plate of the recliner chair, the backrest linkage including a back bracket coupled to the seat support link, a rear bell crank with an upper and lower portion, said upper portion slidably and rotatably coupled to the back bracket and rotatably coupled to the seat support link, said lower portion configured for rotatable coupling with the base plate of the recliner chair, wherein the backrest linkage cooperates to move the recliner mechanism between the open recliner position and a fully-reclined position.

6. The recliner mechanism of claim 5, wherein the orientation of the slot within the ottoman drive link is generally vertical.

7. The recliner mechanism of claim 5, wherein the slidable and rotatable connection between the ottoman drive link and the front pivot link is a pin and slot coupling.

8. The recliner mechanism of claim 7, wherein the pin and slot coupling allows oscillating vertical movement of the pin of the associated coupling while hindering horizontal movement.

9. A linkage mechanism for use in motion furniture, comprising:

a base plate;

a footrest linkage;

a seat support link coupled to the footrest linkage;

front and rear pivot links rotatably coupled to the seat support link and slidably and rotatably coupled to the base plate;

an ottoman drive link slidably and rotatably coupled to an intermediate portion of the front pivot link and rotatably coupled to an intermediate portion of the rear pivot link;

a primary ottoman link coupled between the ottoman drive link and the footrest linkage, the primary ottoman link rotatably coupled to the seat support link, wherein the primary ottoman link and the ottoman drive link cooperate to move the footrest linkage between a closed position and an open position; and a backrest linkage coupling the seat support link to the base plate;

wherein the ottoman drive link cooperates to move the linkage mechanism between a closed position, an open position, and a fully reclined position.

10. The linkage mechanism of claim 9, wherein the backrest linkage includes a back bracket coupled to the seat support link, a rear bell crank with an upper and lower portion, the upper portion rotatably coupled to the back bracket and rotatably coupled to the seat support link, the lower portion rotatably coupled to the base plate.

11. The recliner mechanism of claim 10, wherein the slidable and rotatable connection between the ottoman drive link and the front pivot link is a pin and slot coupling.

12. The recliner mechanism of claim 11, wherein the orientation of the slot is generally vertical.

13. The recliner mechanism of claim 12, wherein the upper portion of the rear bell crank is slidably and rotatably coupled to the back bracket.

* * * * *